US007390398B2

(12) United States Patent
Farshid et al.

(10) Patent No.: US 7,390,398 B2
(45) Date of Patent: Jun. 24, 2008

(54) PROCESS FOR UPGRADING HEAVY OIL USING A HIGHLY ACTIVE SLURRY CATALYST COMPOSITION

(75) Inventors: Darush Farshid, Larkspur, CA (US); Bruce Reynolds, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 300 days.

(21) Appl. No.: 11/303,426

(22) Filed: Dec. 16, 2005

(65) Prior Publication Data

US 2007/0138055 A1 Jun. 21, 2007

(51) Int. Cl.
*C10G 1/08* (2006.01)

(52) U.S. Cl. ..... 208/413; 208/13; 208/418; 208/419; 208/428

(58) Field of Classification Search ..... None
See application file for complete search history.

(56) References Cited

U.S. PATENT DOCUMENTS

| | | | | |
|---|---|---|---|---|
| 3,817,856 | A * | 6/1974 | Aaron et al. | 208/213 |
| 5,371,308 | A * | 12/1994 | Gosselink et al. | 585/251 |
| 5,527,473 | A * | 6/1996 | Ackerman | 210/767 |
| 5,871,638 | A * | 2/1999 | Pradhan et al. | 208/422 |
| 6,139,723 | A * | 10/2000 | Pelrine et al. | 208/422 |
| 6,190,542 | B1 * | 2/2001 | Comolli et al. | 208/423 |
| 6,278,034 | B1 | 8/2001 | Espinoza et al. | |
| 6,660,157 | B2 * | 12/2003 | Que et al. | 208/108 |

OTHER PUBLICATIONS

U.S. Appl. No. 10/938,202 filed Sep. 10, 2004, entitled "Highly Active Slurry Catalyst Composition", 14 pages.
U.S. Appl. No. 10/9380,003 filed Sep. 10, 2004, entitled "Highly Active Slurry Catalyst Composition", 13 pages.
U.S. Appl. No. 10/938,438 filed Sep. 10, 2004, entitled "Process for Recycling an Active Slurry Catalyst Composition in Heavy Oil Upgrading", 15 pages.
U.S. Appl. No. 10/938,200 filed Sep. 10, 2004, entitled "Process for Upgrading Heavy Oil Using a Highly Active Slurry Catalyst Composition", 17 pages.
U.S. Appl. No. 10/938,269 filed Sep. 10, 2004, entitled "Process for Upgrading Heavy Oil Using a Highly Active Slurry Catalyst Composition", 19 pages.

* cited by examiner

*Primary Examiner*—Tam M. Nguyen
(74) *Attorney, Agent, or Firm*—Penny L. Prater

(57) ABSTRACT

Applicants have developed a new residuum full hydroconversion slurry reactor system that allows the catalyst, unconverted oil and converted oil to circulate in a continuous mixture throughout an entire reactor with no confinement of the mixture. The mixture is partially separated in between the reactors to remove only the products and hydrogen gas, while permitting the unconverted oil and the slurry catalyst to continue on into the next sequential reactor. A portion of the unconverted oil is then converted to lower boiling point hydrocarbons, once again creating a mixture of unconverted oil, products, hydrogen, and slurry catalyst. Further hydroprocessing may occur in additional reactors, fully converting the oil. Additional oil may be added at the interstage feed inlet, possibly in combination with slurry. The oil may alternately be partially converted, leaving a highly concentrated catalyst in unconverted oil which can be recycled directly to the first reactor.

20 Claims, 6 Drawing Sheets

PROCESS FOR UPGRADING HEAVY OIL USING A HIGHLY ACTIVE SLURRY CATALYST COMPOSITION

FIELD OF THE INVENTION

The instant invention relates to a process for upgrading heavy oils using a slurry catalyst composition.

BACKGROUND OF THE INVENTION

There is an increased interest at this time in the processing of heavy oils, due to larger worldwide demand for petroleum products. Canada and Venezuela are sources of heavy oils. Processes which result in complete conversion of heavy oil feeds to useful products are of particular interest.

The following patents, which are incorporated by reference, are directed to the preparation of highly active slurry catalyst compositions and their use in processes for upgrading heavy oil:

U.S. Ser. No. 10/938,202 is directed to the preparation of a catalyst composition suitable for the hydroconversion of heavy oils. The catalyst composition is prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

U.S. Ser. No. 10/938,003 is directed to the preparation of a slurry catalyst composition. The slurry catalyst composition is prepared in a series of steps, involving mixing a Group VIB metal oxide and aqueous ammonia to form an aqueous mixture and sulfiding the mixture to form a slurry. The slurry is then promoted with a Group VIII metal. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,438 is directed to a process employing slurry catalyst compositions in the upgrading of heavy oils. The slurry catalyst composition is not permitted to settle, which would result in possible deactivation. The slurry is recycled to an upgrading reactor for repeated use and products require no further separation procedures for catalyst removal.

U.S. Ser. No. 10/938,200 is directed to a process for upgrading heavy oils using a slurry composition. The slurry composition is prepared in a series of steps, involving mixing a Group VIB metal oxide with aqueous ammonia to form an aqueous mixture and sulfiding the mixture to form a slurry. The slurry is then promoted with a Group VIII metal compound. Subsequent steps involve mixing the slurry with a hydrocarbon oil, and combining the resulting mixture with hydrogen gas (under conditions which maintain the water in a liquid phase) to produce the active slurry catalyst.

U.S. Ser. No. 10/938,269 is directed to a process for upgrading heavy oils using a slurry composition. The slurry composition is prepared by a series of steps, involving mixing a Group VIB metal oxide and aqueous ammonia to form an aqueous mixture, and sulfiding the mixture to form a slurry. The slurry is then promoted with a Group VIII metal. Subsequent steps involve mixing the slurry with a hydrocarbon oil and combining the resulting mixture with hydrogen gas and a second hydrocarbon oil having a lower viscosity than the first oil. An active catalyst composition is thereby formed.

SUMMARY OF THE INVENTION

A process for the hydroconversion of heavy oils, said process employing at least two upflow reactors in series with a separator in between each reactor, said process comprising the following steps:

(a) combining a heated heavy oil feed, an active slurry catalyst composition and a hydrogen-containing gas to form a mixture;

(b) passing the mixture of step (a) to the bottom of the first reactor, which is maintained at hydroprocessing conditions, including elevated temperature and pressure;

(c) removing a vapor stream comprising products and hydrogen, unconverted material and slurry catalyst from the top of the first reactor and passing it to a first separator;

(d) in the first separator, removing the products and hydrogen overhead as vapor to further processing and unconverted material and slurry catalyst as a liquid bottoms stream;

(e) combining the bottoms of step (d) with additional feed oil resulting in an intermediate mixture;

(f) passing the intermediate mixture of step (e) to the bottom of the second reactor, which is maintained at hydroprocessing conditions, including elevated temperature and pressure;

(g) removing a vapor stream comprising products and hydrogen, unconverted material and slurry catalyst from the top of the second reactor and passing it to a second separator;

(h) in the second separator, removing the products and hydrogen overhead as vapor to further processing and passing the liquid bottoms stream, comprising unconverted material and slurry catalyst, to further processing.

DETAILED DESCRIPTION OF THE INVENTION

Figure 1:
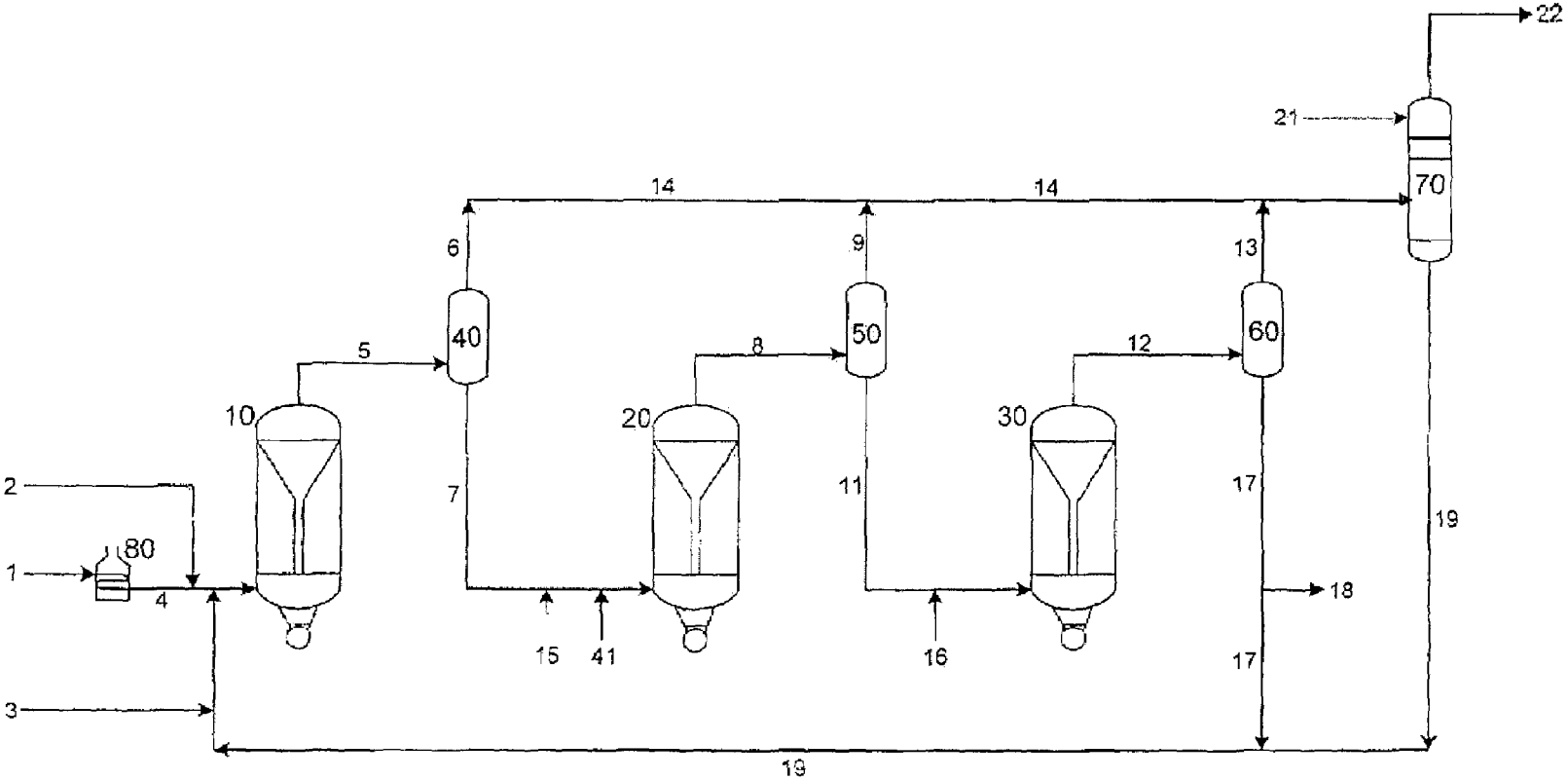
FIGS. 1-6 depict process schemes of this invention with interstage oil addition.

The instant invention is directed to a process for catalyst activated slurry hydrocracking. Interstage separation of products and uncoverted material is effective in maintaining effective heat balance in the process. In FIG. 1, stream 1 comprises a heavy feed, such as vacuum residuum. This feed enters furnace 80 where it is heated, exiting in stream 4. Stream 4 combines with a hydrogen containing gas (stream 2), and a stream comprising an active slurry composition (stream 23), resulting in a mixture (stream 24). Stream 24 enters the bottom of the reactor 10. Vapor stream 5 exits the top of the reactor 10 comprising product and hydrogen gas, as well as slurry and unconverted material. Stream 5 passes to separator 40, which is preferably a flash drum. Product and hydrogen is removed overhead from separator 40 as stream 6. Liquid stream 7 is removed through the bottom of the flash drum. Stream 7 contains slurry in combination with unconverted oil.

Stream 7 is combined with a gaseous stream comprising hydrogen (steam 15) and stream 41 (which comprises an additional feed such as a vacuum gas oil) to create stream 27. Stream 27 enters the bottom of second reactor 20. Vapor stream 8 exits second reactor 20 and passes to separator 50, which is preferably a flash drum. Product and hydrogen gas is removed overhead from separator 50 as stream 9. Liquid stream 11 is removed through the bottom of the flash drum. Stream 11 contains slurry in combination with unconverted oil.

Stream 11 is combined with a gaseous stream comprising hydrogen (steam 16) to create stream 28. Stream 28 enters the bottom of the third reactor 30. Vapor stream 12 exits reactor 30 and passes to separator 60, which is preferably a flash drum. Product and hydrogen gas is removed overhead as stream 13. Liquid stream 17 is removed through the bottom of the flash drum. Stream 17 contains slurry in combination with unconverted oil. A portion of this stream may be drawn off through stream 18.

Overhead streams 6, 9 and 13 create stream 14, which passes to lean oil contactor 70. Stream 21, which contains a lean oil such as vacuum gas oil, enters the top portion of lean oil contactor 70 and flows downward. Products and gas exit lean oil contactor 70 overhead through stream 22, while liquid stream 19 exits at the bottom. Stream 19 comprises a mixture of slurry and unconverted oil. Stream 19 is combined with stream 17, which also comprises a mixture of slurry and unconverted oil. Fresh slurry is added in stream 3, and stream 23 is created. Stream 23 is combined with the feed to first reactor 10.

Figure 2:
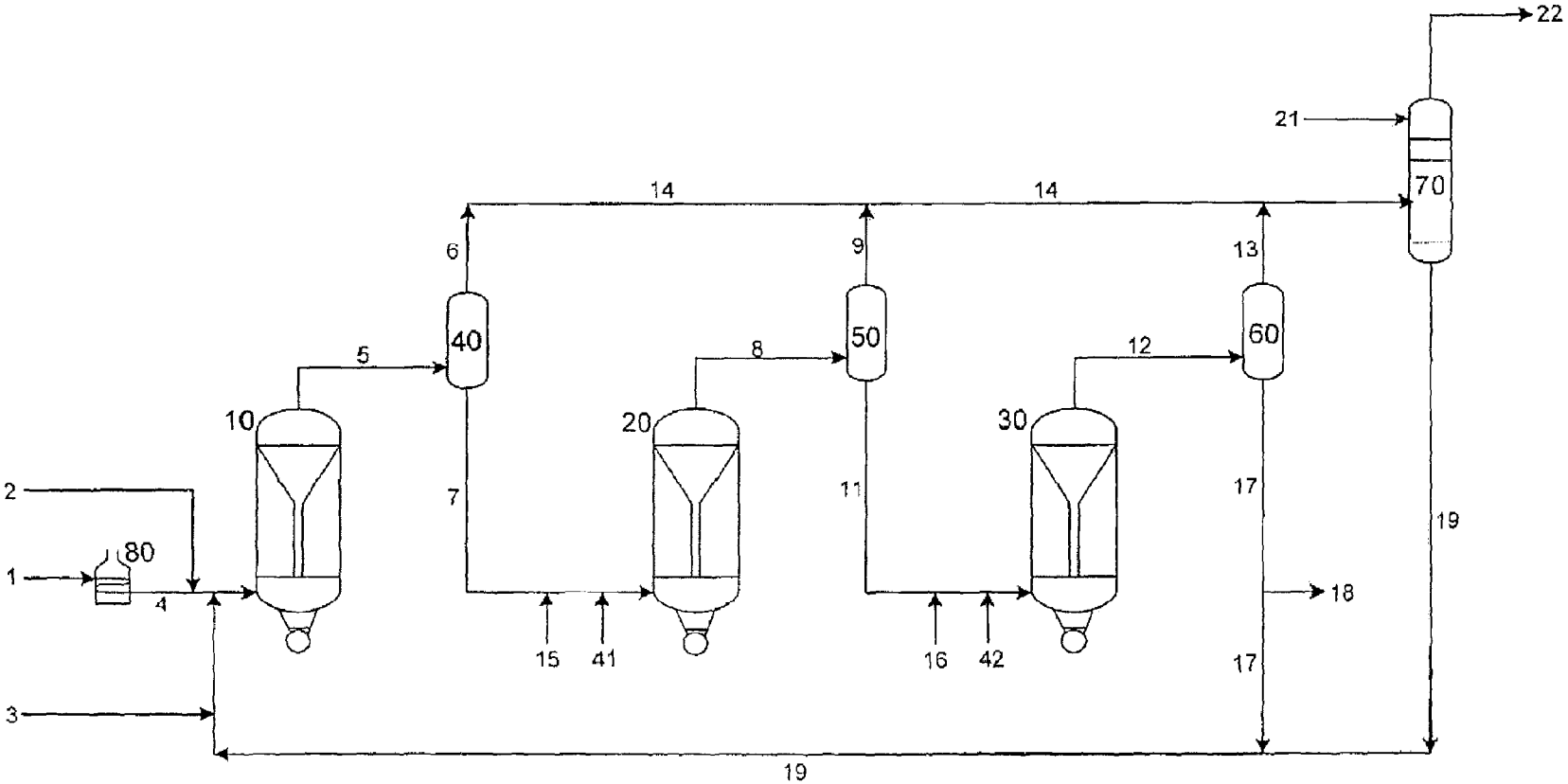

FIG. 2 depicts a flow scheme identical to that of FIG. 1, except that stream 11 is combined with an additional feed stream such as vacuum gas oil, in addition to hydrogen stream 16, in order to create stream 28.

Figure 3:
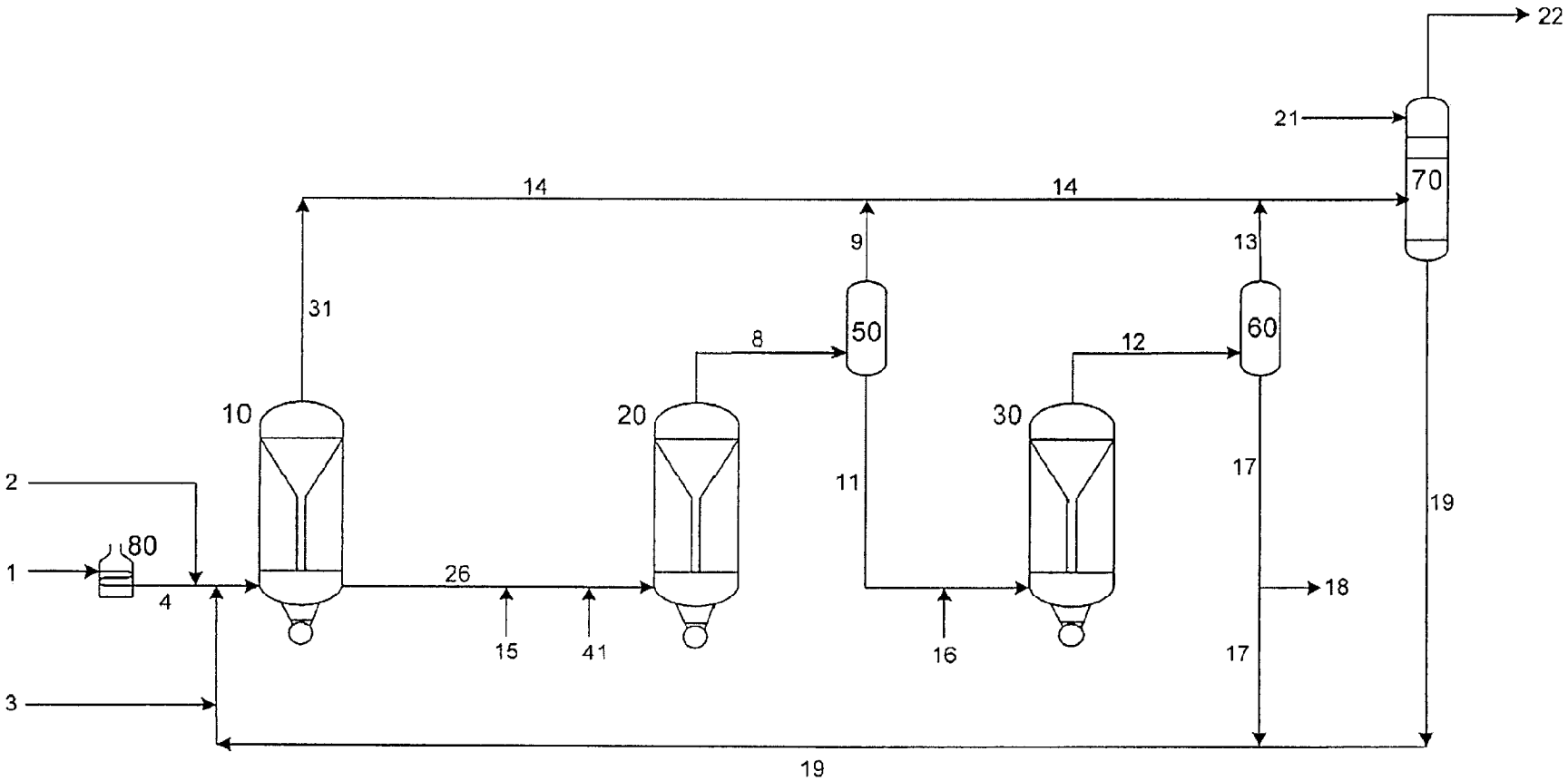
Figure 4:
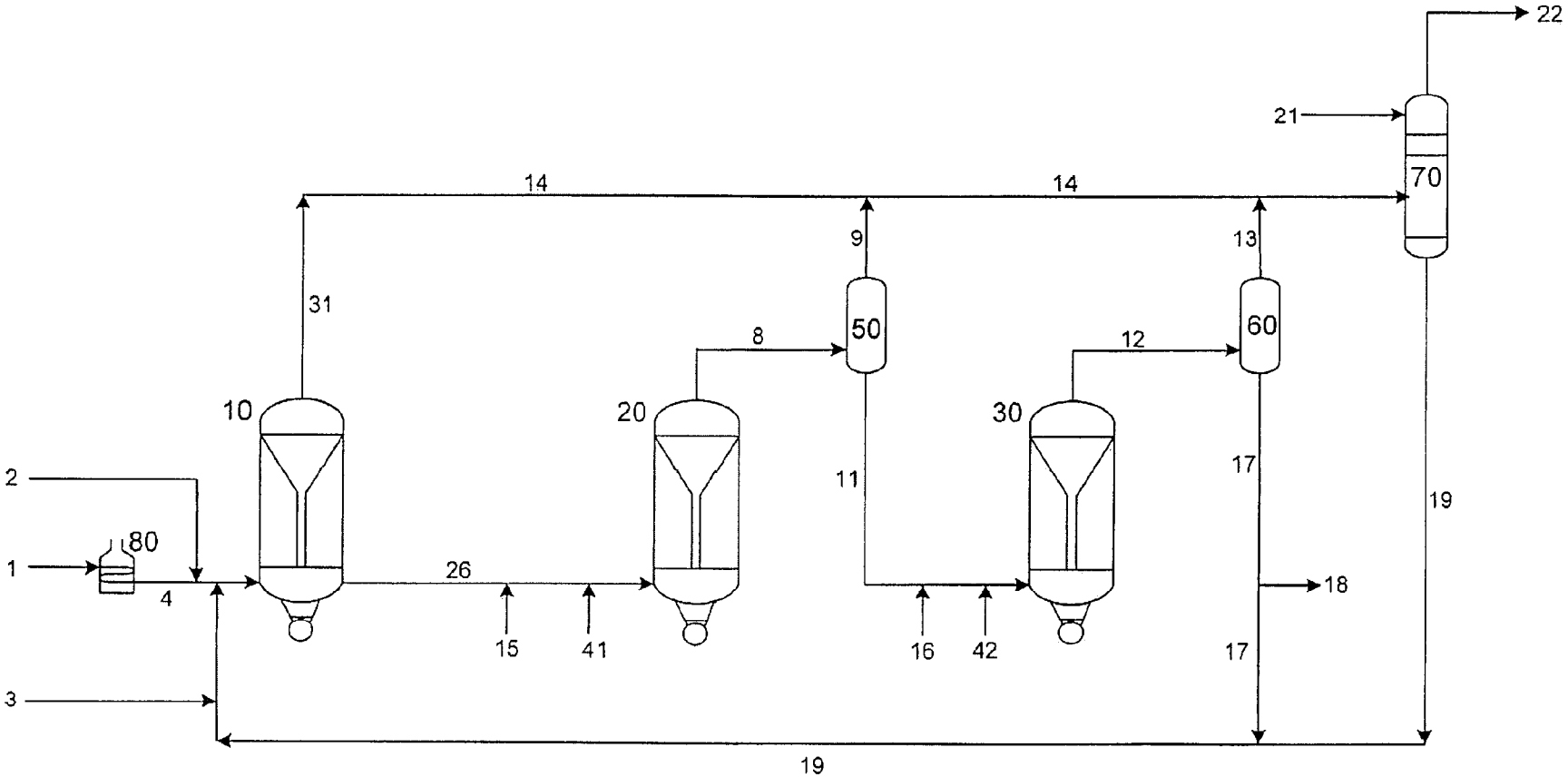
Figure 5:
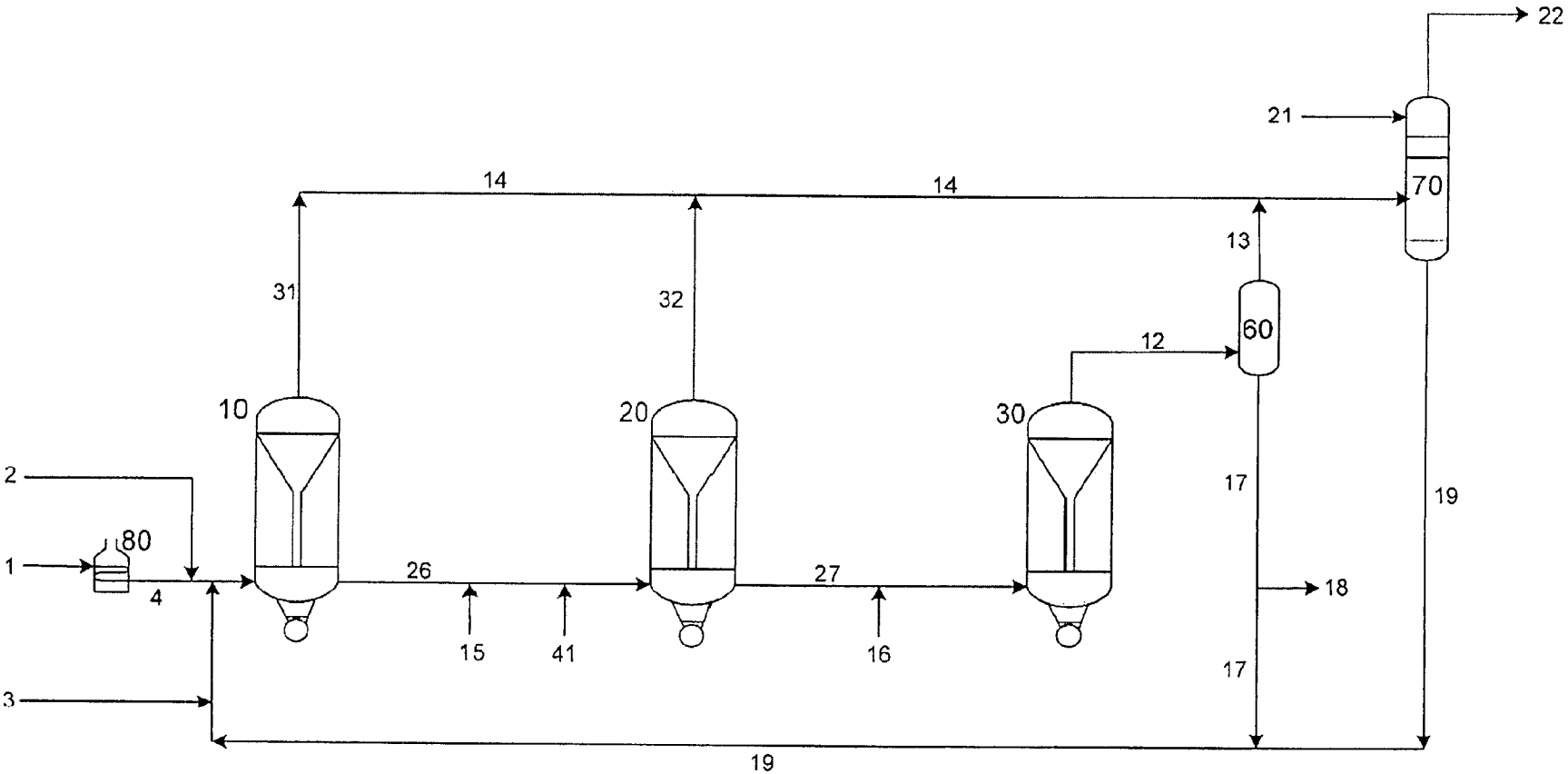

FIGS. 3, 4 and 5 are variations on a multi-reactor flow scheme in which some reactors have an internal phase separation means with in the reactor, and some employ external separation with a flash drum.

In FIG. 3, stream 1 comprises a heavy feed, such as vacuum residuum. This feed enters furnace 80 where it is heated, exiting in stream 4. Stream 4 combines with a hydrogen containing gas (stream 2), and a stream comprising an active slurry composition (stream 23), resulting in a mixture (stream 24). Stream 24 enters the bottom of the reactor 10. Vapor stream 31 exits the top of the reactor comprising products and gases only, due to a separation apparatus inside the reactor. Stream 26, which contains slurry in combination with unconverted oil, exits the bottom of reactor 10.

Stream 26 is combined with a gaseous stream comprising hydrogen (steam 15) and stream 41 (which comprises an additional feed such as a vacuum gas oil) to create stream 27. Stream 27 enters the bottom of second reactor 20. The process continues as illustrated in FIG. 1.

In FIG. 4, Stream 11 is combined with an additional feed (stream 42) as well as with stream 16 to create stream 28. Otherwise FIG. 4 is identical to FIG. 3.

In FIG. 5, stream 1 comprises a heavy feed, such as vacuum residuum. This feed enters furnace 80 where it is heated, exiting in stream 4. Stream 4 combines with a hydrogen containing gas (stream 2), and a stream comprising an active slurry composition (stream 23), resulting in a mixture (stream 24). Stream 24 enters the bottom of the reactor 10. Vapor stream 31 exits the top of the reactor, comprising products and gases only, due to a separation apparatus inside the reactor (not shown). Liquid stream 26, which contains slurry in combination with unconverted oil, exits the bottom of reactor 10.

Stream 26 is combined with a gaseous stream comprising hydrogen (steam 15) and stream 41(which is composed an additional feed such as a vacuum gas oil and may also contain a catalyst slurry) to create stream 27. Stream 27 enters the bottom of second reactor 20. Vapor stream 32 exits the top of the reactor 20 comprising products and gases only, due to a separation apparatus inside the reactor (not shown). Stream 29, which contains slurry in combination with unconverted oil, exits the bottom of reactor 20.

Stream 29 combines with gas containing hydrogen (stream 16) to create stream 28. Stream 28 enters the bottom of the reactor 30. Vapor stream 12 exits the top of the reactor, passing to separator 60, preferably a flash drum. Product and gases are removed overhead as stream 13. Liquid stream 17 is removed through the bottom of separator 60. Stream 17 contains slurry in combination with unconverted oil. A portion of this stream may be drawn off through stream 18.

Overhead streams 31, 32 and 13 create stream 14, which passes to lean oil contactor 70. Stream 21, comprising a lean oil such as vacuum gas oil, enters the top portion of high pressure separator 70. Products and hydrogen exit high pressure separator 70 overhead, while stream 19 exits at the bottom. Stream 19 comprises a mixture of slurry and unconverted oil. Stream 19 is combined with stream 17, which also comprises a mixture of slurry and unconverted oil. Fresh slurry is added in stream 3, and stream 23 is created. Stream 23 is combined with the feed to first reactor 10.

Figure 6:
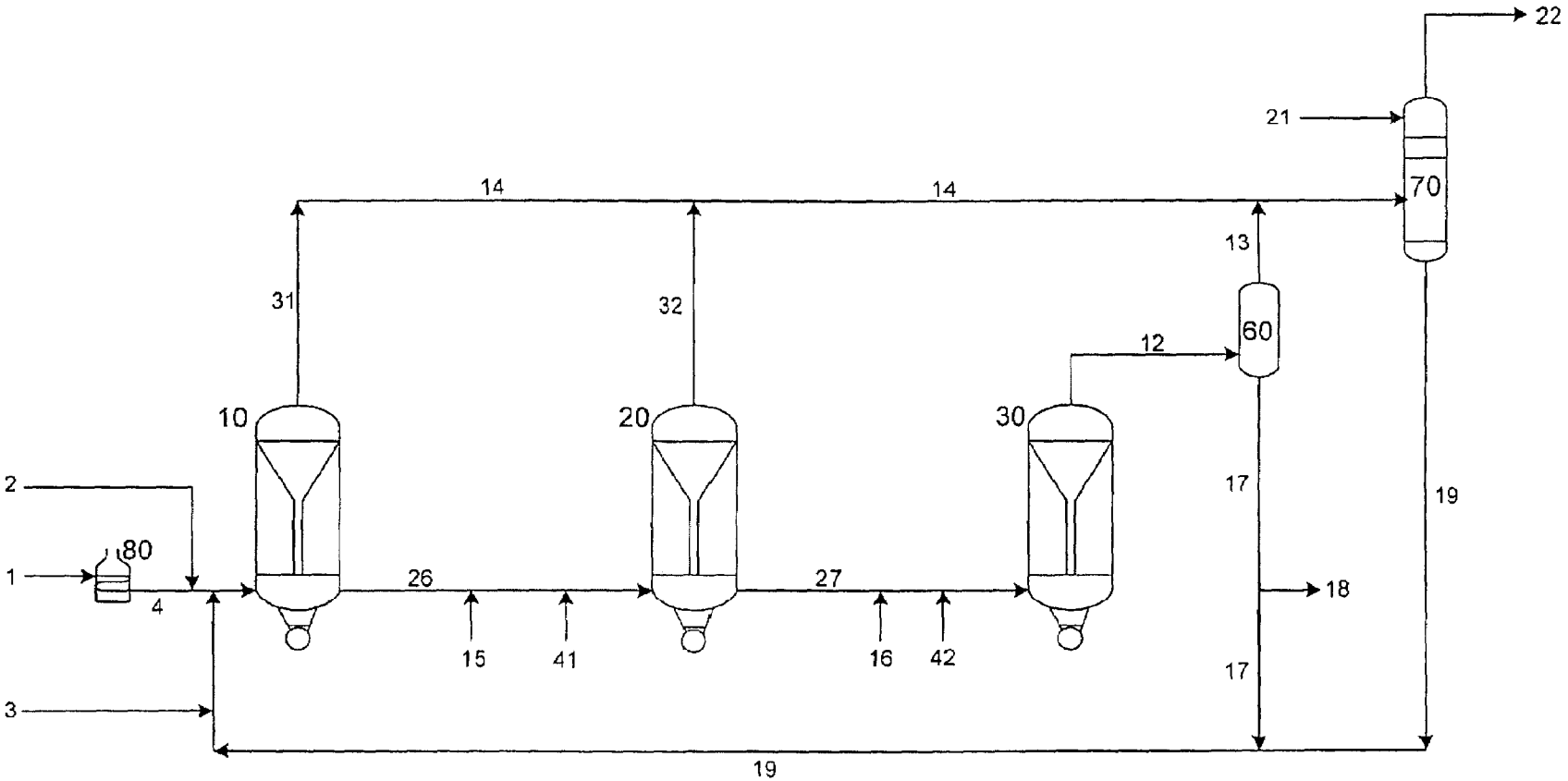

In FIG. 6, Stream 29 is combined with an additional feed (stream 42) as well as with stream 16 to create stream 28. Otherwise FIG. 6 is identical to FIG. 5.

The process for the preparation of the catalyst slurry composition used in this invention is set forth in U.S. Ser. No. 10/938,003 and U.S. Ser. No. 10/938,202 and is incorporated by reference. The catalyst composition is useful for but not limited to hydrogenation upgrading processes such as thermal hydrocracking, hydrotreating, hydrodesulphurization, hydrodenitrification, and hydrodemetalization.

The feeds suitable for use in this invention are set forth in U.S. Ser. No. 10/938,269 and include atmospheric residuum, vacuum residuum, tar from a solvent deasphlating unit, atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers.

The preferred type of reactor in the instant invention is a liquid recirculating reactor, although other types of upflow reactors may be employed. Liquid recirculating reactors are discussed further in copending application Ser. No. 11/305,359, which is incorporated by reference.

A liquid recirculation reactor is an upflow reactor which feeds heavy hydrocarbon oil and a hydrogen rich gas at elevated pressure and temperature for hydroconversion. Process conditions for the liquid recirculating reactor include a pressure in that range from 1500 through 3500 psia and temperature in the range from 700 through 900 F. Preferred conditions include 2000 through 3000 psia and a temperature in the range from 700 through 900 F.

Hydroconversion includes processes such as hydrocracking and the removal of heteroatom contaminants (such sulfur and nitrogen). In slurry catalyst use, catalyst particles are extremely small (1-10 micron). Pumps are not generally needed for recirculation, although they may be used.

What is claimed is:

1. A process for the hydroconversion of heavy oils, said process employing at least two upflow reactors in series with a separator in between each reactor, said process comprising the following steps:

(a) combining a heated heavy oil feed, an active slurry catalyst composition and a hydrogen-containing gas to form a mixture;

(b) passing the mixture of step (a) to the bottom of the first upflow reactor, which is maintained at hydroprocessing conditions, including elevated temperature and pressure;

(c) removing a vapor stream comprising products and hydrogen, unconverted material and slurry catalyst from the top of the first reactor and passing it to a first separator;

(d) in the first separator, removing the products and hydrogen overhead as vapor to further processing and unconverted material and slurry catalyst as a liquid bottoms stream;

(e) combining the bottoms of step (d) with additional feed oil resulting in an intermediate mixture;

(f) passing the intermediate mixture of step (e) to the bottom of the second upflow reactor, which is maintained at hydroprocessing conditions, including elevated temperature and pressure;

(g) removing a vapor stream comprising products and hydrogen, unconverted material and slurry catalyst from the top of the second reactor and passing it to a second separator;

(h) in the second separator, removing the products and hydrogen overhead as vapor to further processing and passing the liquid bottoms stream, comprising unconverted material and slurry catalyst, to further processing.

2. The process of claim 1, in which the liquid bottoms stream from the second upflow reactor, which is feed to one or more additional reactors is combined with additional feed oil prior to entering the additional reactor.

3. The process of claim 2, in which additional feed oil is selected from the group consisting of atmospheric residuum, vacuum residuum, tar from a solvent deasphalting unit, atmospheric gas oils, vacuum gas oils, deasphalted oils, olefins, oils derived from tar sands or bitumen, oils derived from coal, heavy crude oils, synthetic oils from Fischer-Tropsch processes, and oils derived from recycled oil wastes and polymers.

4. The process of claim 3, wherein the additional feed oil is a vacuum gas oil.

5. The process of claim 1, in which the additional feed oil further comprises slurry catalyst.

6. The process of claim 1 wherein the bottoms material of step (h) is recycled to step (a), the mixture of step (a) further comprising recycled unconverted material and slurry catalyst.

7. The process of claim 1 wherein the bottoms material of step (h) is passed to the bottom of a third reactor which is maintained at slurry hydroprocessing conditions, including elevated temperature and pressure.

8. The process of claim 1, in which a liquid recirculating reactor is employed in at least one of the reactors.

9. The process of claim 8, in which the recirculating reactor employs a pump.

10. The process of claim 1, in which hydroprocessing conditions employed in each reactor comprise a total pressure in the range from 1500 to 3500 psia, and a reaction temperature of from 700 to 900 F.

11. The process of claim 10, wherein the preferred total pressure range is from 2000 through 3000 psia and preferred range for reaction temperature is from 775 through 850 F.

12. The process of claim 1 wherein the separator located between each reactor is a flash drum.

13. The hydroconversion process of claim 1, wherein the heavy oil is selected from the group consisting of atmospheric gas oils, vacuum gas oils, deasphalted oils, olefins, oils derived from tar sands or bitumen: oils derived from coal, heavy crude oils, synthetic oils from Fischer-Tropsch processes, and oils derived from recycled oil wastes and polymers.

14. The hydroconversion process of claim 1, wherein the process is selected from the group consisting of hydrocracking, hydrotreating, hydrodesulphurization, hydrodenitrification, and hydrodemetalization.

15. The process of claim 1 wherein the active slurry catalyst composition of claim 1 is prepared by the following steps:

(a) mixing a Group VIB metal oxide and aqueous ammonia to form a Group VIB metal compound aqueous mixture;

(b) sulfiding, in an initial reaction zone, the aqueous mixture of step (a) with a gas comprising hydrogen sulfide to a dosage greater than 8 SCF of hydrogen sulfide per pound of Group VIB metal to form a slurry;

(c) promoting the slurry with a Group VIII metal compound;

(d) mixing the slurry of step (c) with a hydrocarbon oil having a viscosity of at least 2 cSt @ 212° F. to form an intermediate mixture;

(e) combining the intermediate mixture with hydrogen gas in a second reaction zone, under conditions which maintain the water in the intermediate mixture in a liquid phase, thereby forming an active catalyst composition admixed with a liquid hydrocarbon; and (f) recovering the active catalyst composition.

16. The process of claim 1, wherein at least 90 wt % of the feed is converted to lower boiling products.

17. A process for the hydroconversion of heavy oils, said process employing at least two upflow reactors in series with a separator located internally in the first reactor, said process comprising the following steps:

(a) combining a heated heavy oil feed, an active slurry catalyst composition and a hydrogen-containing gas to form a mixture;

(b) passing the mixture of step (a) to the bottom of the first upflow reactor, which is maintained at hydroprocessing conditions, including elevated temperature and pressure;

(c) separating internally in the first reactor a stream comprising product, hydrogen gases, unconverted material and slurry catalyst into two streams, one vapor stream comprising products and hydrogen gases and one liquid stream comprising unconverted material and slurry catalyst;

(d) withdrawing the vapor stream comprising products and gases overhead to further processing, and passing the liquid stream comprising unconverted material and slurry catalyst from the first reactor as a bottoms stream;

(e) combining the bottoms stream of step (d) with additional feed oil resulting in an intermediate mixture;

(f) passing the intermediate mixture of step (e) to the bottom of the second upflow reactor, which is maintained at hydroprocessing conditions, including elevated temperature and pressure;

(g) removing a vapor stream comprising product, hydrogen unconverted material and slurry catalyst from the top of the second reactor and passing it to a separator;

(h) in the separator, removing the products and hydrogen overhead to further processing and passing the liquid bottoms material, comprising unconverted material and slurry catalyst to further processing.

18. The process of claim 16, in which feed to one or more additional reactors is combined with additional feed oil prior to entering the reactor.

19. A process for the hydroconversion of heavy oils, said process employing at least two upflow reactors in series with a separator located internally in both reactors, said process comprising the following steps:

(a) combining a heated heavy oil feed, an active slurry catalyst composition and a hydrogen-containing gas to form a mixture;

(b) passing the mixture of step (a) to the bottom of the first upflow reactor, which is maintained at hydroprocessing conditions, including elevated temperature and pressure;

(c) separating internally in the first reactor a vapor stream comprising products and hydrogen, unconverted material and slurry catalyst into two streams, one vapor stream comprising products and hydrogen and one comprising unconverted material and slurry catalyst;

(d) withdrawing the vapor stream comprising products and hydrogen overhead to further processing, and passing the liquid stream comprising unconverted material and slurry catalyst from the first reactor as a bottoms stream;

(e) combining the bottoms stream of step (d) with additional feed oil resulting in an intermediate mixture;

(f) passing the intermediate mixture of step (e) to the bottom of the second upflow reactor, which is maintained at hydroprocessing conditions, including elevated temperature and pressure;

(g) separating internally in the second reactor a vapor stream comprising products and gases, unconverted material and slurry catalyst into two streams, one vapor stream comprising products and hydrogen and one liquid stream comprising unconverted material and slurry catalyst;

(h) withdrawing the stream comprising products and hydrogen overhead to further processing, and passing the unconverted material and slurry catalyst from the first reactor as a liquid bottoms stream for further processing.

20. The process of claim 18, in which feed to one or more additional reactors is combined with additional feed oil prior to entering the reactor.

* * * * *